US005532549A

United States Patent [19]

Duzyk et al.

[11] Patent Number: 5,532,549

[45] Date of Patent: Jul. 2, 1996

[54] COATED, LABELED FLUORESCENT LAMP

[75] Inventors: Edward F. Duzyk, Meadville, Pa.; Wallace E. Fizer, Lexington, Ky.

[73] Assignee: Trojan, Inc., Mt. Sterling, Ky.

[21] Appl. No.: 24,518

[22] Filed: Mar. 2, 1993

[51] Int. Cl.[6] ..... H01J 61/35

[52] U.S. Cl. ..... 313/489; 313/635

[58] Field of Search ..... 313/489, 635, 313/493; 427/106

[56] References Cited

U.S. PATENT DOCUMENTS

| | | | |
|---|---|---|---|
| 3,018,187 | 1/1962 | Boyce et al. . | |
| 3,102,049 | 8/1963 | Quirk . | |
| 3,753,036 | 8/1973 | Roche | 313/493 |
| 3,864,855 | 2/1975 | Pekko et al. . | |
| 3,902,946 | 9/1975 | Audesse et al. . | |
| 3,937,853 | 2/1976 | Shank, Jr. . | |
| 3,959,525 | 5/1976 | Sentementes et al. . | |
| 4,239,261 | 12/1980 | Richardson . | |
| 4,469,353 | 9/1984 | Anarwala . | |
| 4,499,850 | 2/1985 | Nolan . | |
| 4,506,189 | 3/1985 | Nolan et al. . | |
| 4,507,332 | 3/1985 | Nolan et al. . | |
| 4,674,771 | 6/1987 | Thompson II . | |
| 4,893,840 | 1/1990 | Berkowitz . | |
| 5,043,626 | 8/1991 | Nolan | 313/635 |

*Primary Examiner*—Sandra L. O'Shea
*Assistant Examiner*—Matthew J. Esserman
*Attorney, Agent, or Firm*—Fitch, Even, Tabin & Flannery

[57] ABSTRACT

A coated, labeled fluorescent lamp wherein the label is applied prior to coating, and wherein after labeling, the label, glass tube and portion of the end caps are covered with a coating material which is heated to form a tough, smooth, uninterrupted light-transmitting coating. The coating preferably bonds to the label to provide tamper resistance for the label, in addition to containment of shattered glass and lamp contents in the event of breakage of the lamp.

11 Claims, 12 Drawing Sheets

COATED, LABELED FLUORESCENT LAMP

BACKGROUND OF THE INVENTION

The invention relates generally to application of coatings to fluorescent lamps, and more specifically to application of protective coatings for containment of shattered glass and interior components of the lamps in the event of breakage.

It is known in the art that application of a protective coating to a fluorescent lamp can enable containment of shattered glass in the event of breakage. Fluorescent lamps with protective coatings are widely used in locations where breakage may contaminate food products, and in other environments where particular precautions against environmental contamination are needed.

In the past, a variety of methods have been employed to apply coatings of various kinds to fluorescent lamps, as well as to incandescent lamps and photoflash lamps.

U.S. Pat. No. 3,959,525 discusses dip-coating of photoflash lamps to apply a protective lacquer coating to reinforce a glass envelope and improve its containment capability. This patent describes employment of dip-coating to apply cellulose acetate or polycarbonate coatings, and states that fluidized bed coating techniques have been employed to apply cryogenically ground polycarbonate resin and other thermoplastic materials.

U.S. Pat. No. 3,902,946 discloses spraying of a silicone release agent onto the glass envelope of a photoflash lamp, then placing the lamp in a preformed sleeve of thermoplastic material which is subsequently vacuum-formed onto the glass envelope.

U.S. Pat. No. 3,018,187 describes application of silicone coatings to the envelopes of fluorescent lamps by means of dip or spray systems. The function of the silicone coating is to prevent moisture from condensing on or otherwise contacting the envelope in order to minimize problems encountered in starting "rapid-start" and "instant-start" fluorescent lamps under high humidity conditions.

U.S. Pat. No. 3,102,049 also discusses application of a water repellent film to a "rapid start" fluorescent lamp, to avoid start-up problems cause by high atmospheric humidity. This patent discloses a coating method in which fluorescent lamps are rolled through the solution to cover the entire external surface of the glass envelope, with guide bars placed in the solution at a depth of about ¼ inch below the liquid so that the ends of the lamp and those parts of the lamp which will be employed in making electrical contacts will not be coated.

It is believed that silicone solutions have also been applied to tubular fluorescent lamps by rollers, with lower portions of the rollers rotating through a silicone solution or emulsion, and upper portions of the rollers in rolling contact with rotating lamps rotated about their axes.

U.S. Pat. Nos. 4,507,332, 4,506,189, and 4,499,850 discuss coating of fluorescent lamps with Surlyn powder in a fluidized bed. The stated purpose of the coating is to collect glass shards upon the glass envelope being broken and maintaining the glass shards and end caps in association within the coating.

A polyvinylchloride (PVC) coating can be applied to fluorescent lamps by a dip-coating process, and such a coating is capable of providing highly effective containment of shattered glass and internal lamp components in the event of breakage. It has been found that dip-coating of fluorescent lamps in a PVC plastisol provides an effective means of applying coating material to the lamps. However, in the past, commercial methods for coating of fluorescent lamps with PVC plastisol have been relatively labor-intensive. Known prior art methods of applying PVC plastisol to fluorescent lamps have been batch-coating operations, wherein a batch of fluorescent lamps are supported for rotation on a movable rack, and the rack is moved manually to effect the necessary steps for coating. Such methods have inherent inefficiencies due to the time and care required load and unload the relatively fragile lamps, and to perform other steps on the lamps in each batch individually.

In a known batch-coating method, the rack has pairs of adapters to support the lamps at their opposite ends by engagement with the end caps and electrical connecting pins, and one of each pair of adapters is driven to rotate the lamps about their respective axes. A primer is manually applied about the periphery of the end caps to improve bonding of the coating material to the end caps. The primer is applied by placing a hand-held brush in contact with each end cap as the lamps rotate. The rack and lamps are inserted in an oven for preheating for a brief period of time, then withdrawn from the oven by returning the rack to its original position. The rack is then pivoted to dip the lamps into contact with the surface of a bath of liquid plastisol while they are rotated about their axes. The electrical contact pins are maintained above the level of the plastisol bath as the lamps are rotated. After the tubular glass central portion of the lamp and peripheral regions of the end caps have been coated with the liquid plastisol, the lamps are lifted from the bath and replaced in the oven, while still rotating, to effect gelation of the liquid plastisol into a tough, transparent solid coating. The rack is then manually withdrawn from the oven once again, and after the lamps have cooled by exposure to ambient air for a short period of time, adhesive-backed labels are manually applied to the lamps. The lamps are then manually removed from the adapters.

One of the problems in coating with PVC plastisol as described above is that the operator must periodically replenish the bath to maintain the surface at a satisfactory level. Monitoring of the level is complicated by the fact that the level increases somewhat due to displacement as the lamps are lowered into the bath, and due to the relatively high viscosity of the plastisol. If the level is too high relative to the lamps, the result may be an unacceptable buildup of plastisol on the electrical connecting pins, end caps, and/or the adapters. The high viscosity of the plastisol exacerbates this problem. After curing, such buildups may be difficult to remove, and may require individual manual removal with a knife of other appropriate tool.

It is a general object of the invention to provide a more efficient and economical method and apparatus for applying a protective coating to fluorescent lamps to contain the glass envelopes and internal lamp components in the event of failure of the glass envelope. Among the problems addressed by the invention in this connection are control of the level of the liquid plastisol in the bath, and take-off of coated lamps in a more efficient manner without increased breakage.

Another object of the invention concerns labeling of the coated fluorescent lamps. It has been found that labels which have been applied conventionally to such lamps are subject to removal and misuse after the end of the useful life of the lamp. Accordingly, it is a further object of the invention to provide a tamper-resistant label for coated fluorescent lamps.

SUMMARY OF THE INVENTION

In accordance with one aspect of the invention, there is provided a method and apparatus for effecting continuous in-line surface preparation and coating of fluorescent lamps.

In a preferred embodiment of the invention, each lamp is supported at opposite ends by rotatable adapters and is continuously advanced at a substantially constant speed in a direction generally transverse to the lamp axis throughout the coating process, while being selectively rotated as it is advanced. Peripheral regions of the end caps of the lamps are preferably treated with wire brushes or other abrasive material as the lamps are advanced. One or more air knives may be employed to remove dust and other particulate matter from the lamps prior to coating. The lamps are thereafter lowered into contact with the surface of a bath of liquid coating material while rotating and continuously advancing, so that the glass cylinder and the peripheries of the end caps are coated. The liquid coating material is then cured, and the lamps are then supported from below by a pair of take-off wheels while the adapters are separated to release the lamps. A pair of guides engage the end caps to maintain the lamps in position for engagement by the take-off wheels.

In accordance with a further aspect of the invention, there is provided an improved labeling arrangement for coated fluorescent lamps, wherein a label composed of a static cling vinyl material is placed directly on the lamp, and the lamp is then dip-coated in a PVC plastisol which covers the label and resists tampering with the label, in addition to providing containment for shattered glass and interior lamp components in the event of breakage of the lamp.

Further aspects of the invention are set forth below.

DETAILED DESCRIPTION OF PREFERRED EMBODIMENTS

Figure 1:
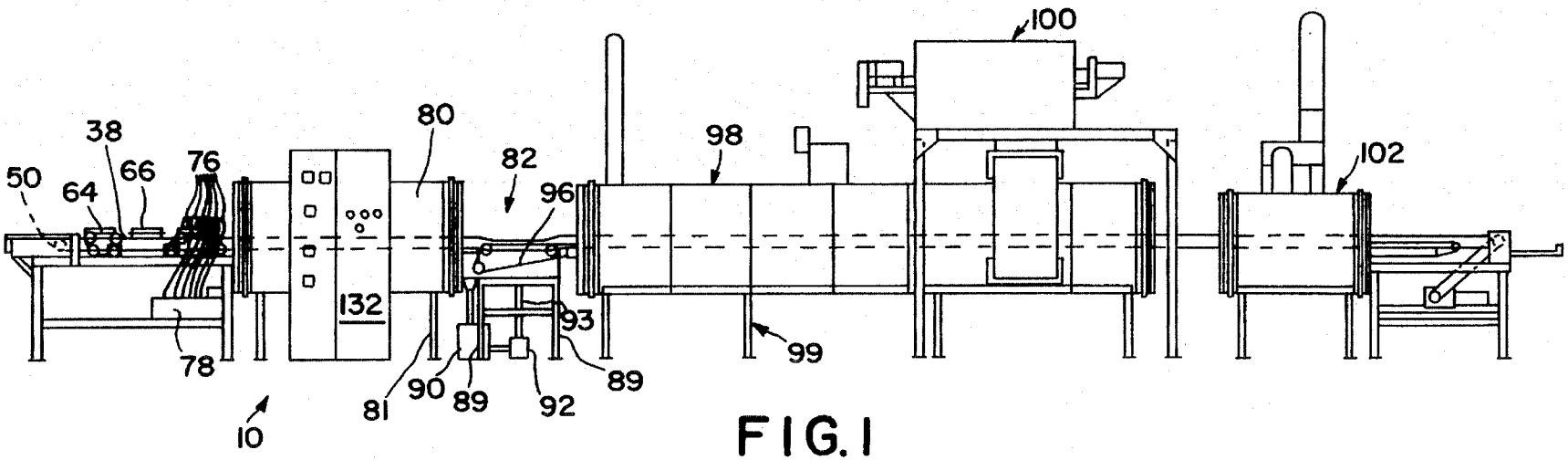
FIG. 1 is an elevational view of apparatus in accordance with an embodiment of the invention.

The invention is generally embodied in a method and apparatus 10 for coating fluorescent lamps 12 with a tough, substantially transparent coating which provides containment of shattered glass in the event of breakage, and in an improved labeling arrangement for such lamps.

In the embodiment illustrated and described in detail herein, the lamps 12 being coated are standard fluorescent lamps having an elongated glass tube 14 with metallic end caps 16 disposed at opposite ends of the glass tube, and a pair of parallel electrical connecting pins 18 extending outward, generally perpendicular to the end surface 20 of each end cap. It will be appreciated that in other embodiments of the invention, fluorescent lamps having different end configurations might be processed using apparatus modified suitably to accommodate such lamps.

Figure 2:
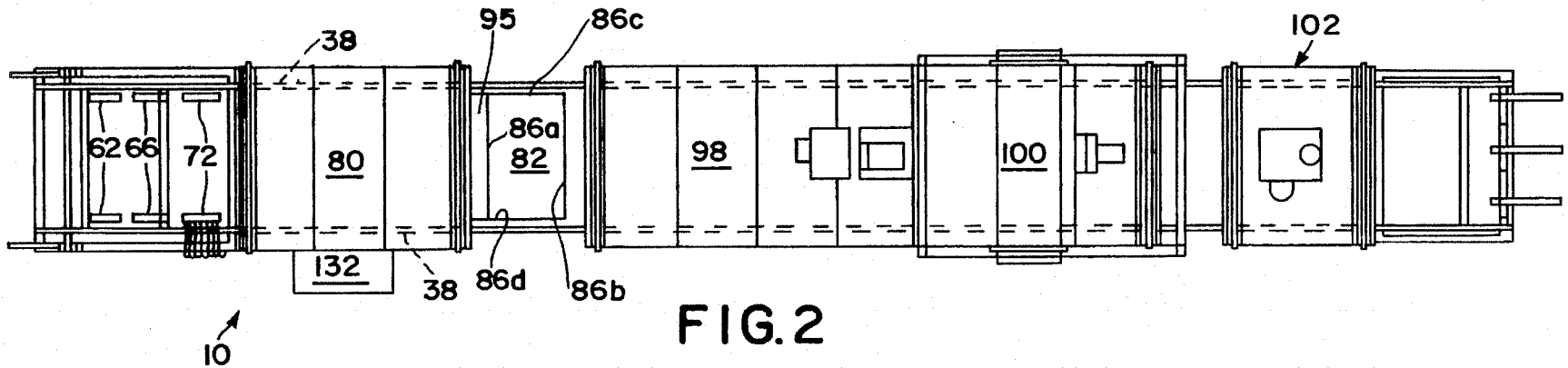
FIG. 2 is a plan view of the apparatus of FIG. 1.
Figure 7:
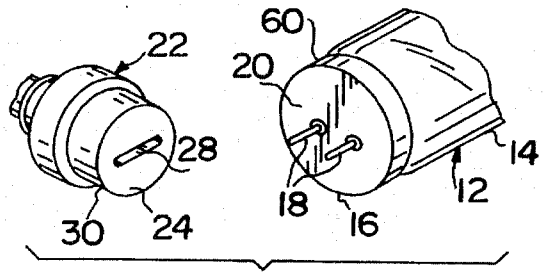
FIG. 7 is a perspective view illustrating an end cap of a fluorescent lamp in conjunction with an adapter for receiving the electrical connecting pins and supporting an end of the fluorescent lamp by engaging the end cap and electrical connecting pins.

The apparatus 10 illustrated in FIG. 1 comprises means for supporting the lamps 12 by their ends and rotating the lamps about their longitudinal axes while transporting them in a direction generally transverse to the longitudinal axes of the lamps through a series of processing locations, proceeding generally from left to right in FIGS. 1 and 2. At the left-hand end of the apparatus, lamps are loaded onto the apparatus sequentially by placing the opposite ends of each lamp 12 in engagement with respective adapters 22 and 23 on opposite sides of the apparatus 10.

Each lamp is supported by an opposed pair of adapters 22 and 23. The adapters 22 along one side of the apparatus are spring-loaded and movable over a limited range axially with respect to the lamps 12. The adapters 23 along the opposite side are axially fixed. The adapters 22 and 23 have substantially planar, vertically-oriented surfaces 24 and 25 respectively which abut the opposite end surfaces 20 of the end caps 16. Each of the adapters has a slot 28 formed in its end surface to receive the electrical connecting pins 18 extending from the ends of the lamps. Each of the illustrated adapters also has a substantially cylindrical peripheral surface 30 adjacent its end surface with a diameter smaller than that of the end cap 16.

Each of the axially-movable adapters 22 is mounted at the inner end of a generally horizontal shaft 32 which is slidably supported by a support block 34 for axial travel over a limited range. A coil spring 36 loaded in compression extends about the shaft 32 between the adapter 22 and the support block 34. Each adapter 22 is movable between an inner position at which the end faces 24 and 25 of the respective opposed adapters 22 and 23 in each pair are spaced from one another by a distance substantially equal to the distance between the opposite end faces 20 of the lamp, and an outer position in which the respective adapters are spaced apart by a distance at least equal to the total length of the lamp 12, including the electrical connecting pins 18.

The lamp 12 is loaded by inserting one pair of pins 18 in the slot 28 on the axially-movable adapter 22, then displacing the adapter 22 toward its second position and inserting the opposite pair of pins 18 in the slot on the axially-fixed adapter 23, then aligning the end face 20 of the lamp with the axially-fixed adapter 23.

The means for transporting the lamps 12 through the apparatus 10 preferably comprise a pair of main drive chains 38, each comprising a plurality of links pivotally connected by pins 40. Each of the support blocks 34 is mounted on a supporting link 42 which comprises inner and outer angle-section link plates. Each of the inner and outer angle-section link plates comprises a substantially vertical portion 46 extending downward from the support block and a substantially horizontal outwardly extending portion 48 which engages the support block 34 from below. Each of the supporting links 42 is connected with adjacent supporting links on either side by a series of three connecting links 44 arranged in a conventional manner.

The main drive chains 38 and support blocks 34 are maintained in proper alignment by sliding engagement of the chains 38 with chain rails 37, and by sliding engagement of grooves 39 in the support blocks 34 with stationary members 41 of the frame of the apparatus.

Figure 5:
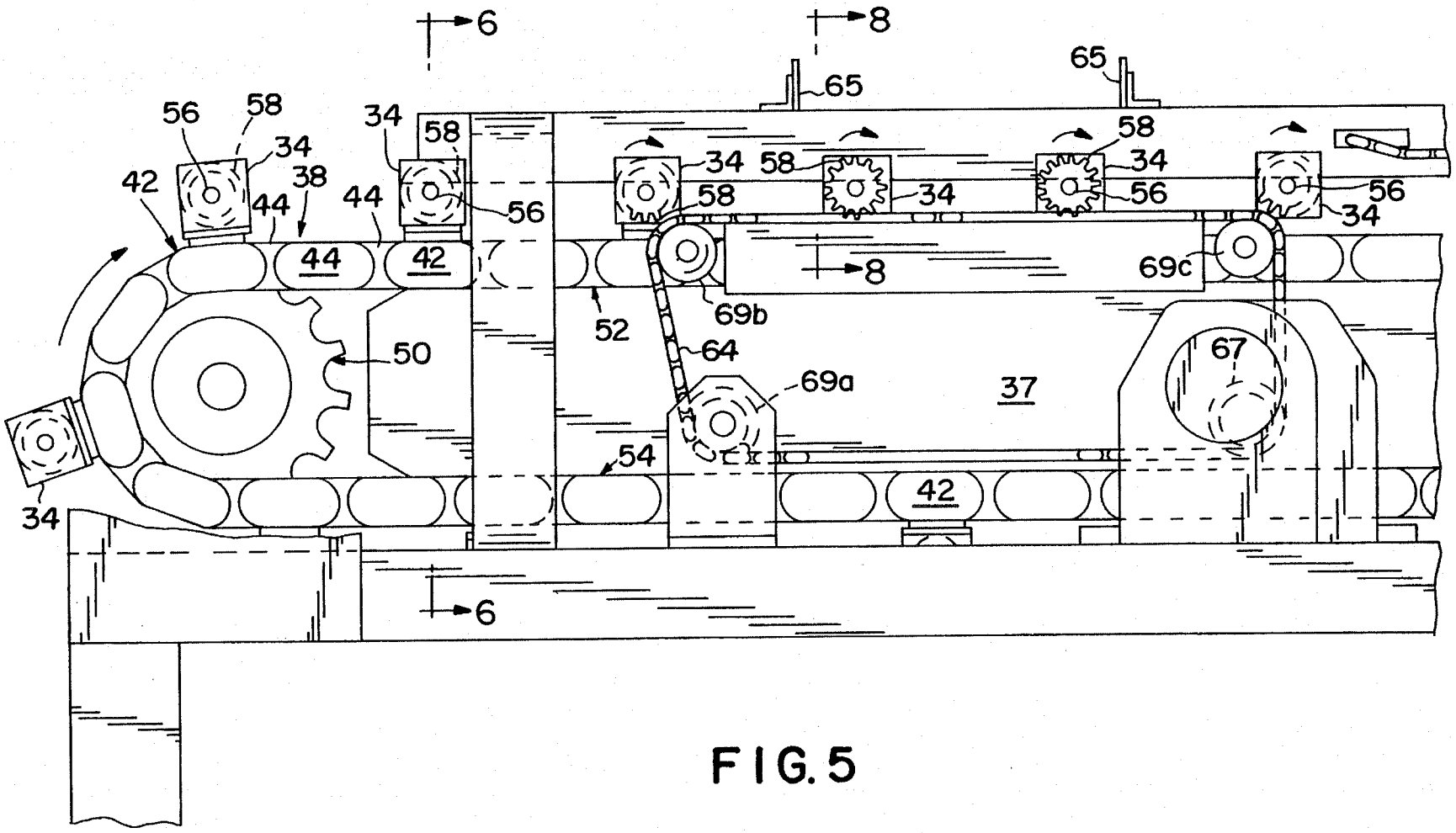
FIG. 5 is an elevational view of the portion of the apparatus of FIG. 1, shown on an enlarged scale and with portions broken away for clarity.
Figure 8:
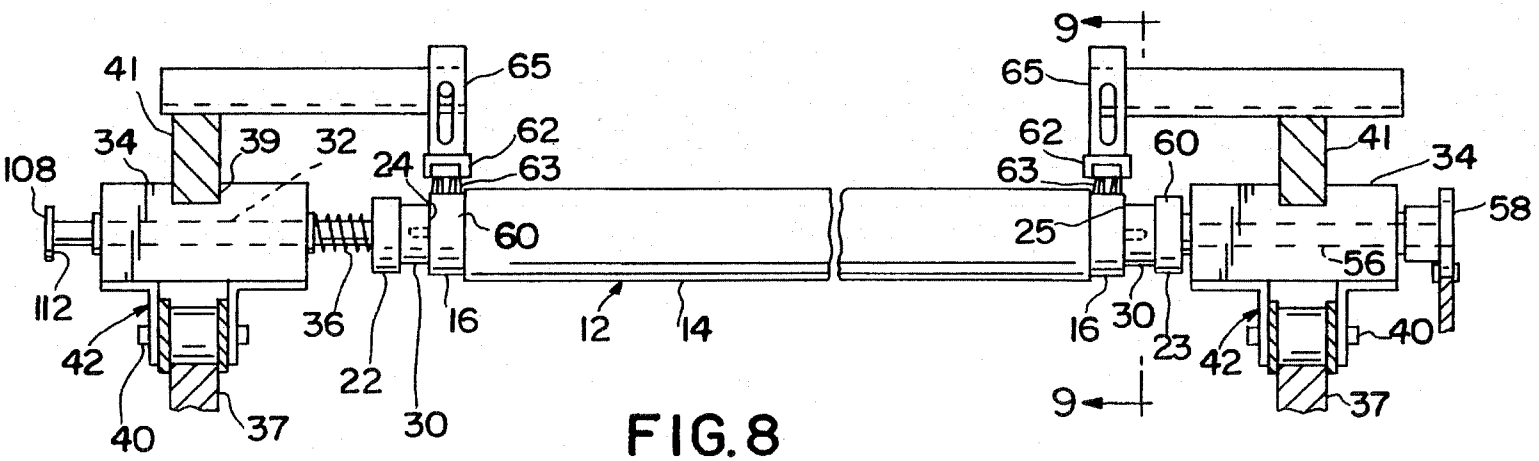
FIG. 8 is a sectional view taken substantially along line 8—8 in FIG. 5.

At the input end of the apparatus 10, illustrated at the left end of FIGS. 1 and 2, and shown on an enlarged scale in FIG. 5, each main drive chain 38 engages an idler sprocket 50 and traverses a 180° turn, having substantially horizontal upper and lower portions 52 and 54, respectively. The sprockets 50 rotate in a clockwise direction as viewed in FIG. 5 during normal operation of the apparatus, with the support blocks 34 and their respective associated adapters on the upper portions 52 of the chains traveling from left to right in FIG. 1.

Each of the axially-fixed adapters 23 is supported on an axially-fixed rotatable shaft 56. Like the axially movable shafts 32, each of the axially-fixed shafts 56 extends through a support block 34 mounted on a supporting link 42. Each of the axially-fixed adapter shafts 56 has a sprocket 58 at its outer end, opposite the adapter 23, to enable the associated adapter 23 and lamp to be selectively rotated.

Figure 9:
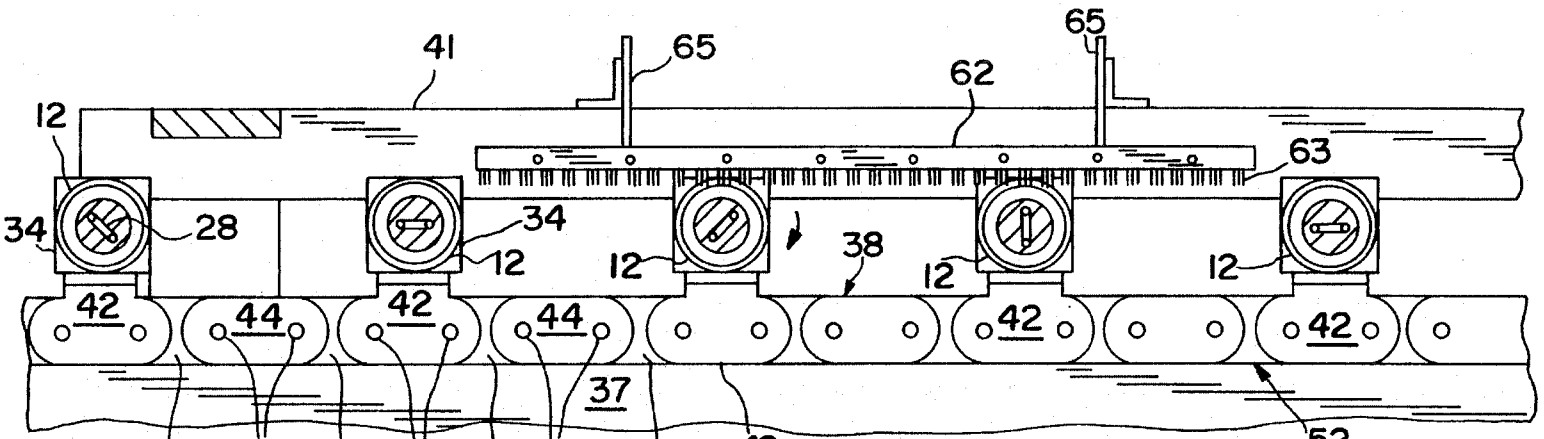
FIG. 9 is a sectional view taken substantially along line 9—9 in FIG. 8.

To prepare the peripheral surfaces 60 of the end caps 16 for coating, a pair of elongated stationary wire brushes 62 engage the peripheral surfaces of the end caps. Each brush has a series of wire bristles arranged substantially linearly to engage the end caps for an extended period of time. The lamps are rotated by engagement of a roller chain 64 with the sprockets 58 on the respective axially-fixed adapters 23 as the lamps are carried past the brushes 62. The sprockets 58 are engaged from below by the roller chain 64 which is driven generally counterclockwise in a loop to rotate each lamp at relatively high speed through at least 360°, and preferably through several revolutions, during its contact with the brushes. The chain 64 is supported on a drive sprocket 67 and three idler sprockets 69*a*, 69*b* and 69*c*. The rotation of the lamps is in a clockwise direction with reference to FIG. 9 so that the velocity of the upper surfaces of the lamps due to rotation is in substantially the same direction as the linear travel of the lamps. Each of the brushes is supported by a pair of adjustable brackets 65 so as to be vertically adjustable.

Figure 10:
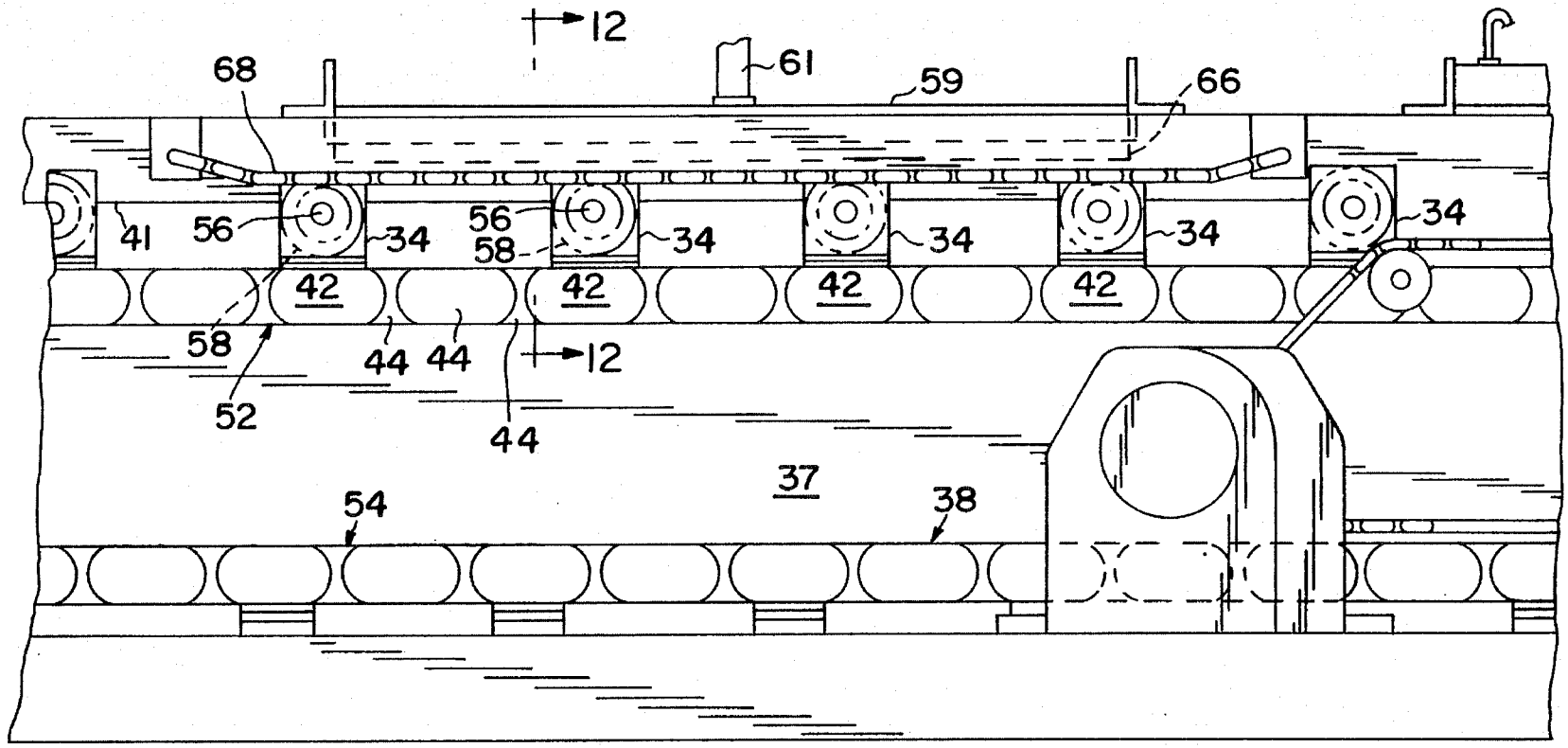
FIG. 10 is an elevational view of a portion of the apparatus of FIG. 1 adjacent the portion shown in FIG. 5, shown on an enlarged scale relative to FIG. 1.
Figure 11:
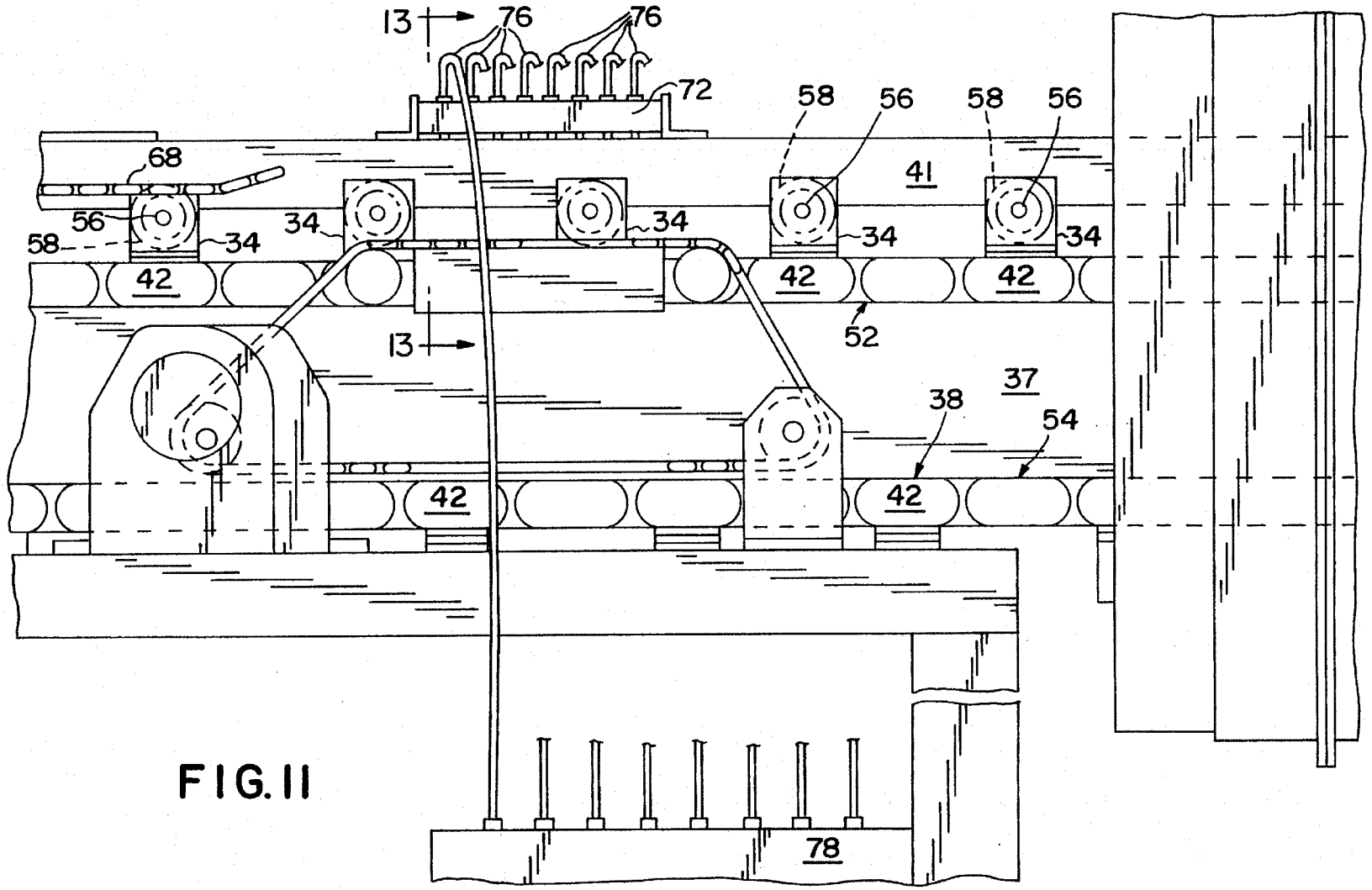
FIG. 11 is an elevational view of a portion of the apparatus of FIG. 1 adjacent and to the right of that illustrated in FIG. 10, shown on an enlarged scale relative, to FIG. 1, and with portions broken away for clarity.
Figure 13:
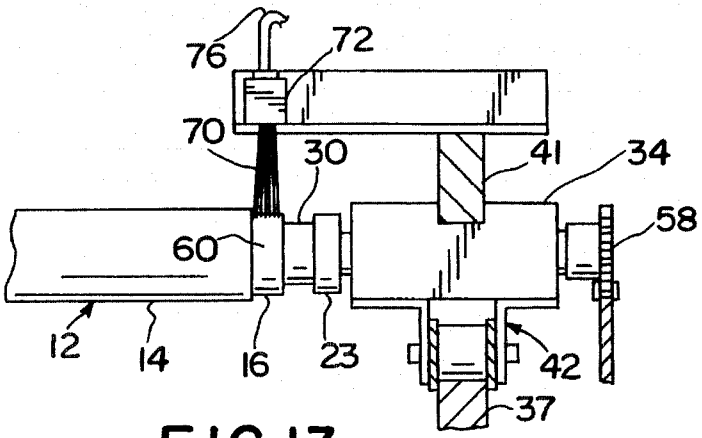
FIG. 13 is a sectional view taken substantially along line 13—13 in FIG. 11.
Figure 12:
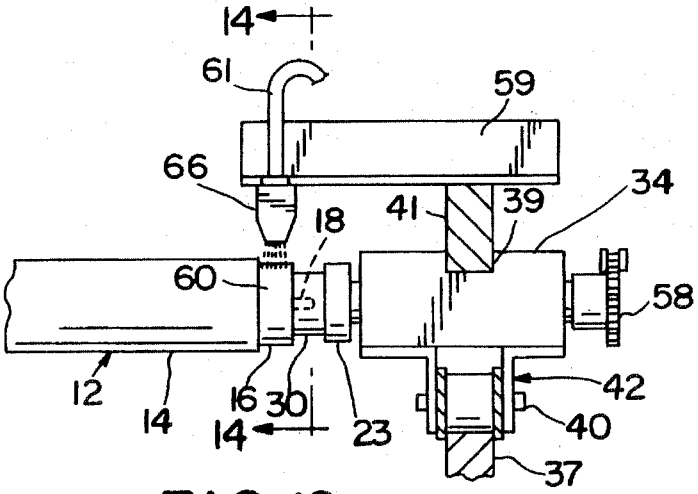
FIG. 12 is a sectional view taken substantially along line 12—12 in FIG. 10.
Figure 14:
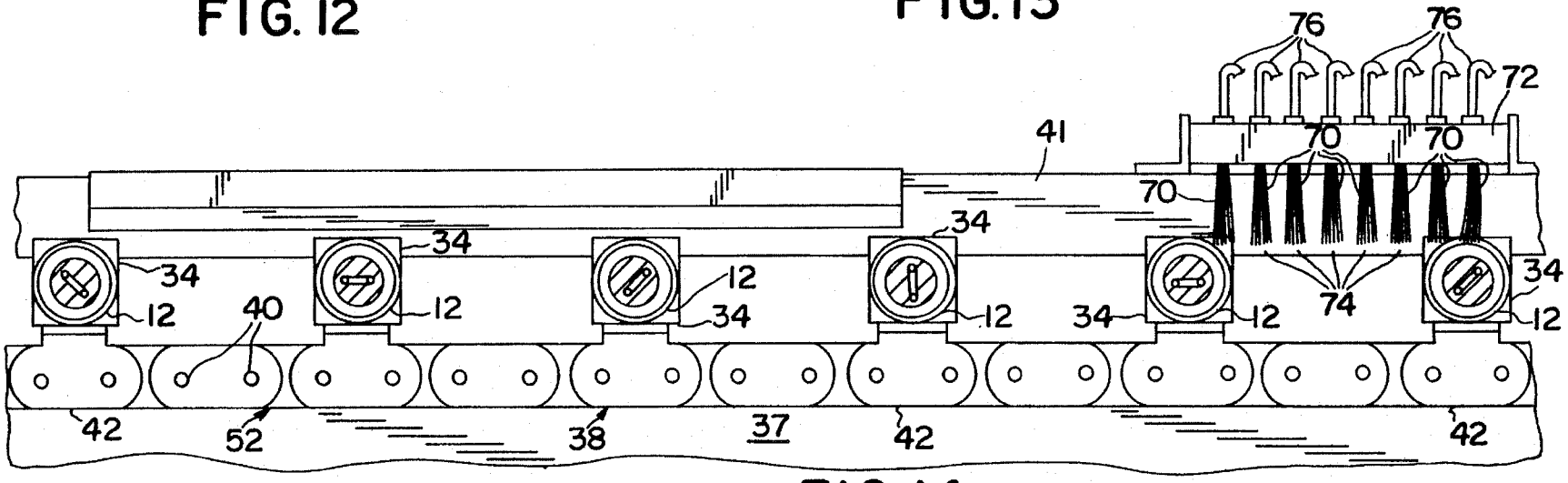
FIG. 14 is an elevational view of an additional portion of the apparatus of FIG. 1, shown on an enlarged scale relative to FIG. 1.

Following the wire brush operation, the lamps 12 are subjected to high velocity airflow to remove dust and any other loose particulate matter therefrom. As shown in FIG. 10, an air knife 66 is preferably employed for this purpose. The air knife is supported on a bracket 59. Pressurized air is supplied to the air knife 66 by a hose 61. The lamps are rotated through at least 360 ° rotation at relatively low velocity while being subjected to airflow from the air knife 66. To achieve the desired rotation, a stationary length of roller chain 68 engages the sprockets 58 from above as the lamps pass.

A primer is subsequently applied to the peripheral surfaces 60 or the end caps as the lamps 12 are advanced and rotated. Application of primer is effected through the use of a series of brushes 70 supported on a rack 72 such that the bristles of the brushes extend downwardly with the lower ends 74 of the bristles deflected slightly by, and engaging, the peripheral surfaces of the end caps of the lamps as they pass. Primer is supplied to the respective brushes by a series of tubular supply lines 76 extending upward from a reservoir 78. In the illustrated embodiment, eight separate brushes 70 are provided in a row along each side of the apparatus, and a separate supply line is associated with each of the brushes 70.

After the application of primer, the lamps are preferably transported into a first oven 80 wherein the lamps are heated as they advance continuously through the oven. In the preferred embodiment, electric radiant heaters are employed in the first oven 80 to raise the surface temperature of the lamps to about 125° F. The oven 80 has substantially rectangular openings at opposite ends to permit the lamps to pass through. Its interior is otherwise closed. The oven 80 is supported on a frame 81. It is believed that the temperature to which the lamps are heated at this point is not critical, and that acceptable coating results may be obtained by heating the lamps to lower or higher temperatures in the first oven 80.

Figure 15:
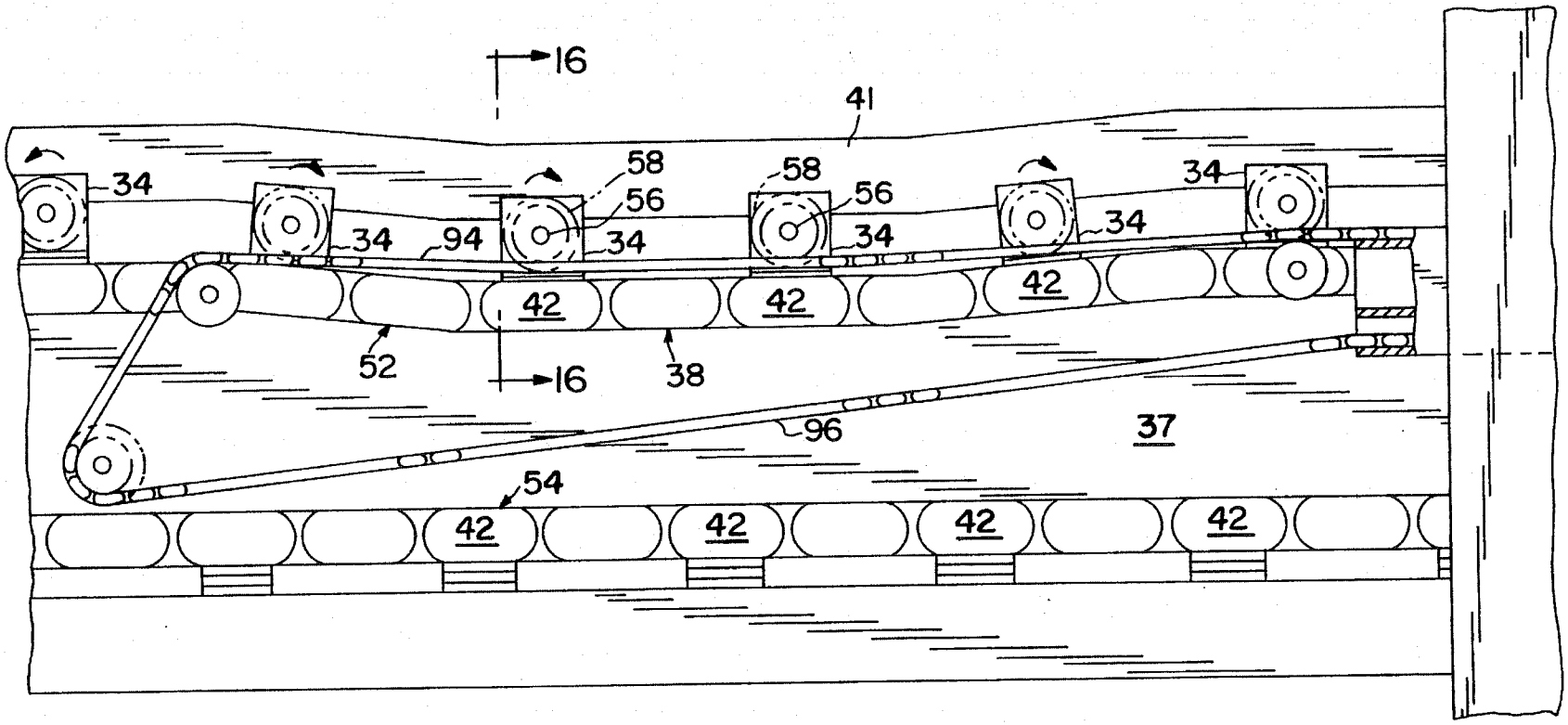
FIG. 15 is an elevational view of an additional portion of the apparatus of FIG. 1, shown on an enlarged scale relative to FIG. 1.
Figure 16:
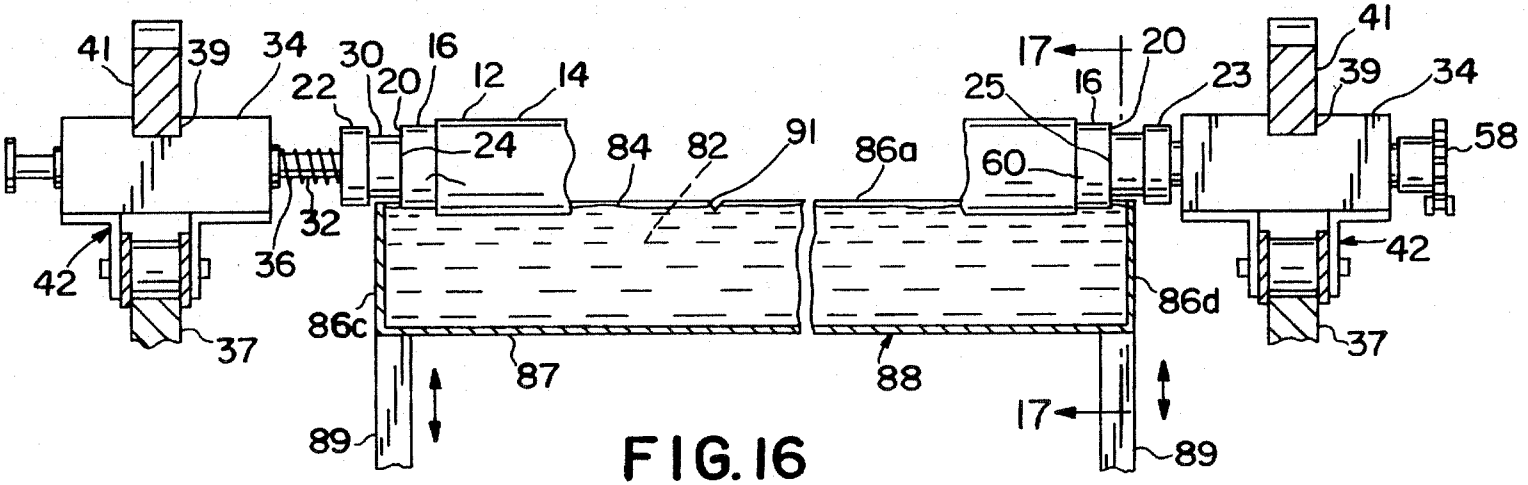
FIG. 16 is a sectional view taken substantially along line 16—16 in FIG. 15.
Figure 17:
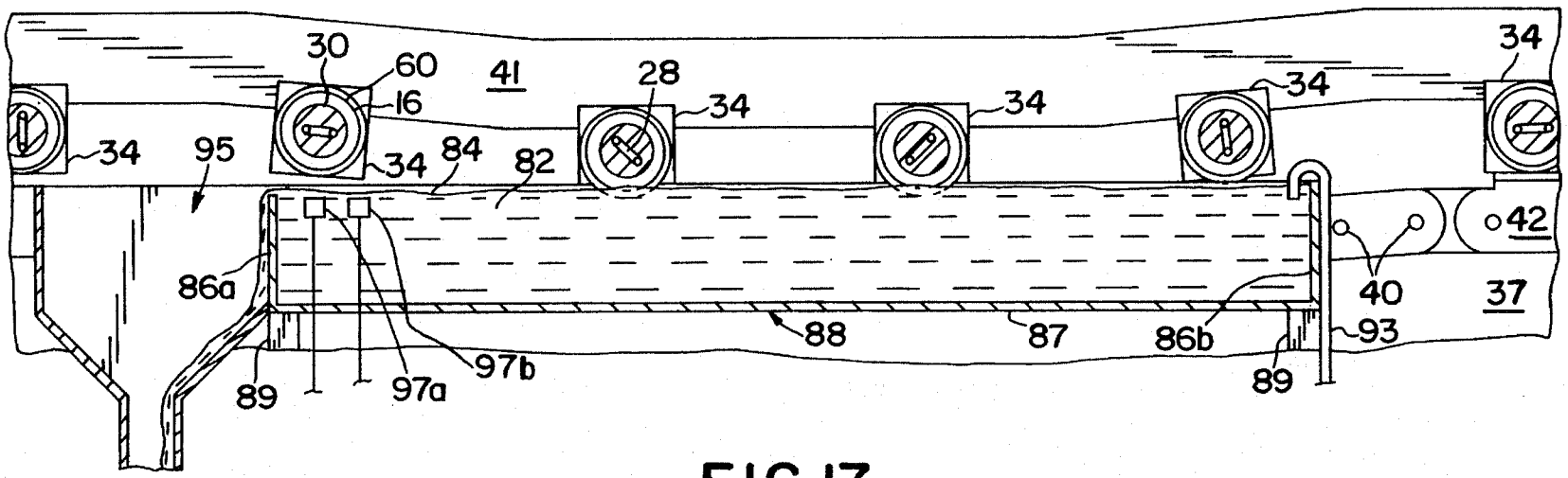
FIG. 17 is a sectional view taken substantially along line 17—17 in FIG. 16.

Upon emerging from the oven, the lamps are brought into contact with the surface 84 of a bath 82 of liquid coating material, which in a preferred embodiment of the invention comprises a PVC plastisol which has high temperature stability. Such plastisols are commercially available from various sources. As shown in FIGS. 15 and 17, the upper portions of the main drive chains 38 are deflected downward by a stationary guide as they pass over the bath. The difference between the diameter of the adapters 22 and 23 and the diameter of the lamp end caps 16 enables the cylindrical peripheral surfaces 60 of the end caps, as well as the elongated cylindrical glass surface 14, to contact the liquid coating material while the adapters 22 and 23 remain above the surface 84 of the liquid bath 82.

As shown in FIG. 17, the bath 82 is contained in a shallow, generally rectangular pan 88. The pan 88 is supported on legs 89 of adjustable length, which enable the pan height to be changed to accommodate variations in lamp diameter. The pan has a generally rectangular bottom 87. Integral front and rear walls 86*a* and 86*b*, and side walls 86*c* and 86*d*, extend upward from the bottom 87. The front, rear and side walls 86*a–d* have substantially coplanar and horizontal upper edges. To maintain the level of the bath surface slightly below the upper edges of the wall, a notch 91 is provided in the front wall 86*a*. The bath level is increased as necessary by addition of liquid coating material to the bath from a reservoir 90 disposed beneath the bath, through a supply line 93. A pump 92 is employed to effect flow of liquid coating material from the reservoir 90 to the pan 88. Liquid which flows through the notch 91 in the front wall 86*a* is captured by a drain 95 which returns it to the reservoir 90. As shown in FIG. 17, the arrangement of the drain 95 and supply line 93, relative to the direction of travel of the lamps 12, provides a counterflow arrangement whereby fluid flow in the reservoir runs in a direction opposite to the direction of travel of the lamps. A liquid level sensing device 97*a* may be employed to send information to a pump controller so that the pump may be automatically actuated in response to a drop in the bath level.

Generally, during operation of the apparatus, heat will be transferred to the bath from the lamps. Optimal coating results may be obtained when the bath temperature is maintained at between about 65° F. and about 95° F. To enable the temperature to be controlled, the reservoir temperature is preferably maintained below 90° F., and means are provided to effect flow of relatively low-temperature liquid from the reservoir to the bath in response to undesirably high bath temperature conditions. To this end, a temperature sensor 97*b* may be provided in the bath to relay information to a pump controller which activates the pump in response to sensing of undesirably high bath temperatures. Suitable conventional refrigeration apparatus may be employed to maintain the reservoir temperature suitably low, if necessary.

As the lamps travel, they are rotated clockwise as viewed in FIG. 15, by engagement of sprockets 58 with an upper portion 94 of a chain 96 which is driven counterclockwise beneath the sprockets 58. Clockwise rotation of the lamps is at a relatively low speed, and approximates rolling contact between the lamps and the surface of the bath 82. That is, as the lamp rotates and advances, the velocity of the lowermost portion of the lamp at any time is relatively small. The lamps preferably rotate at about 8–15 rpm. The lamps are thus coated with liquid while advancing and rotating without interruption and with little or no undesired spillage of the liquid coating material. As they approach the end of the bath, the lamps are raised out of contact with the bath of liquid coating material while continuing to rotate and advance.

Lowering and raising of the lamps as described above is effected by providing gradual slopes of, e.g., about 5°–10°, on the upper surfaces of the chain rails 37 and on the lower surfaces of the stationary frame members 41, adjacent the bath 82.

After being raised from the surface of the bath, the lamps proceed into an elongated curing oven 98 which cures the liquid coating material into a tough, substantially transparent protective coating. The curing oven 98 has entry and exit ports at its opposite ends to permit the lamps to pass through, and is supported on a frame 99. In a preferred embodiment of the invention, the oven temperature is maintained at about 400°–450° F. for between about three minutes and about five minutes. A gas-fired burner system is preferably employed to heat the oven. It will be appreciated that acceptable coating results may be obtained with various oven temperatures and various curing times. Appropriate ventilation equipment 100 is preferably employed to exhaust products of combustion from the burners, as well as fumes generated during the curing of the coating.

Figure 3:
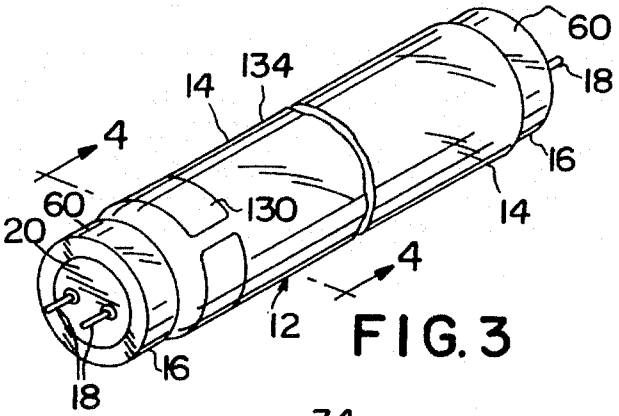
FIG. 3 is a foreshortened perspective view of a fluorescent lamp coated in accordance with the invention.
Figure 6:
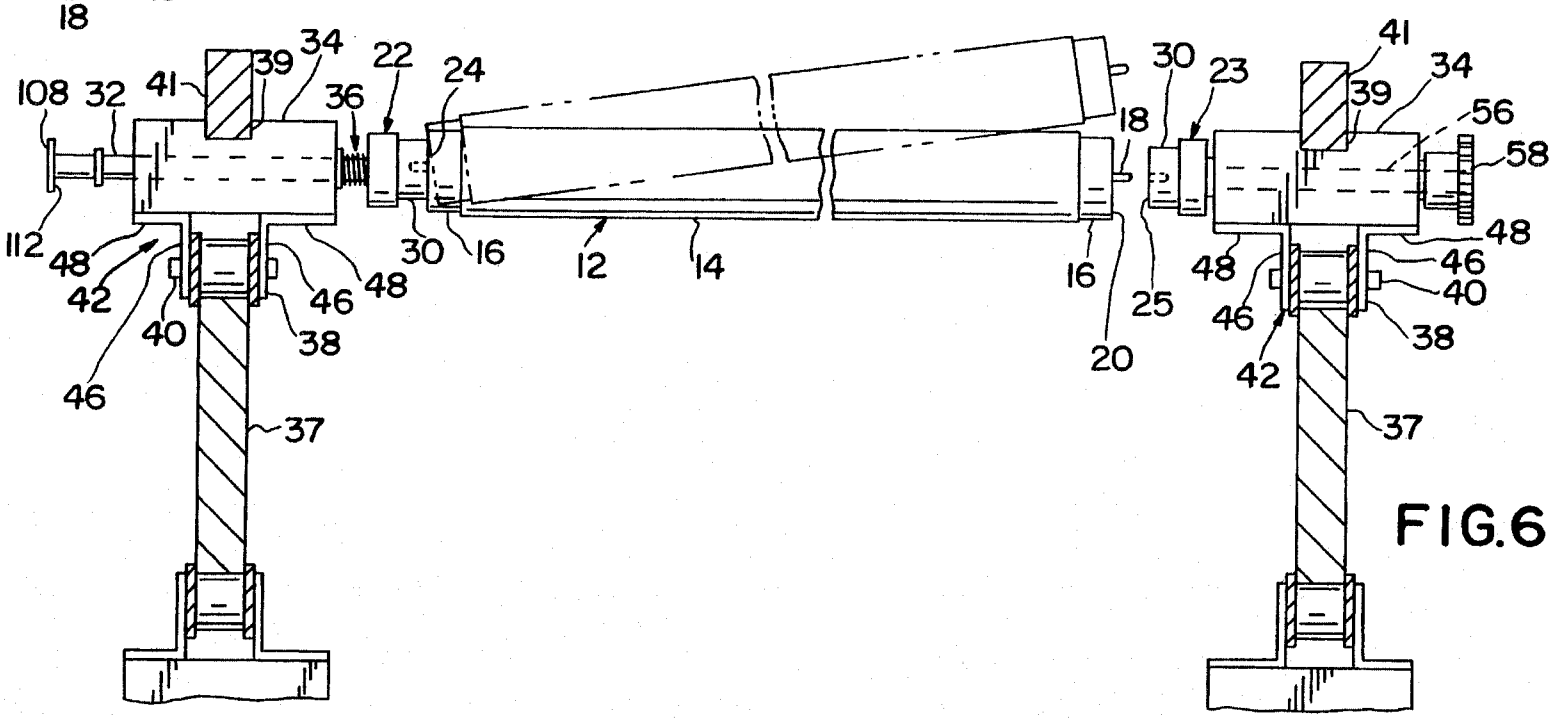
FIG. 6 is a sectional view taken substantially along line 6—6 in FIG. 5.

The sprockets 58 remain in engagement with chain 96 and are rotated continuously as they travel through the curing oven 98, to ensure that the coating cures evenly into a smooth surface. In the preferred embodiment of the invention employing a PVC plastisol liquid coating material, the curing comprises gelation. The PVC plastisol, which in liquid form is a milky white liquid, upon gelation becomes substantially transparent and has mechanical strength sufficient to withstand stresses typically associated with lamp breakage. After gelation, the coating has sufficient strength and toughness to contain shattered glass as well as the internal components of the lamps in the event of breakage. As shown in FIG. 3, the coating on the finished product preferably extends onto the end surfaces 20 on the end caps 16 of the lamps 12.

Upon emerging from the curing oven 98, the lamps 12 are exposed to ambient air for a short time, then enter a cooling chamber 102 in which they are subjected to forced airflow. The cooling chamber 102 preferably is capable of employing ambient air for cooling purposes, and is also equipped with means for cooling the air in the chamber so that cooling of the lamps can be accelerated. A conventional refrigeration unit or water-cooled heat exchanger may be appropriate. The lamps 12 are rotated continuously as they travel through the cooling chamber 102.

Figure 19:
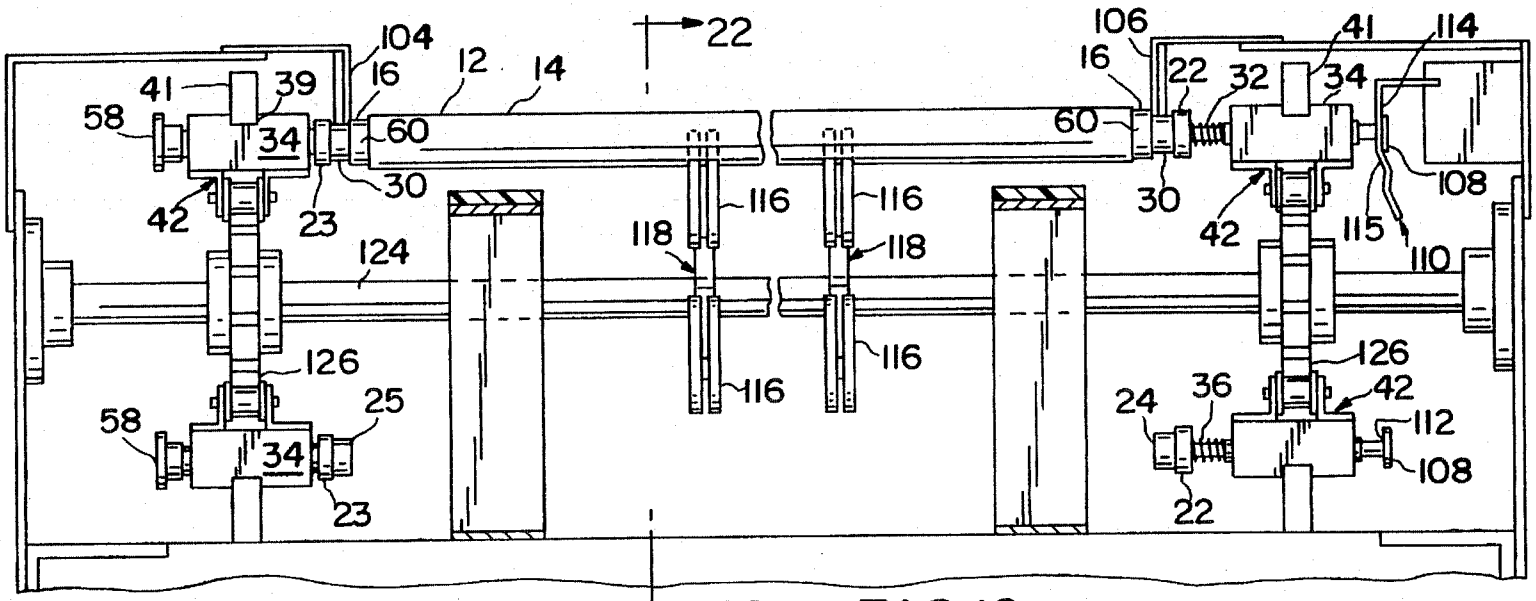
FIG. 19 is a transverse sectional elevational view taken substantially along line 19—19 in FIG. 18.
Figure 20:
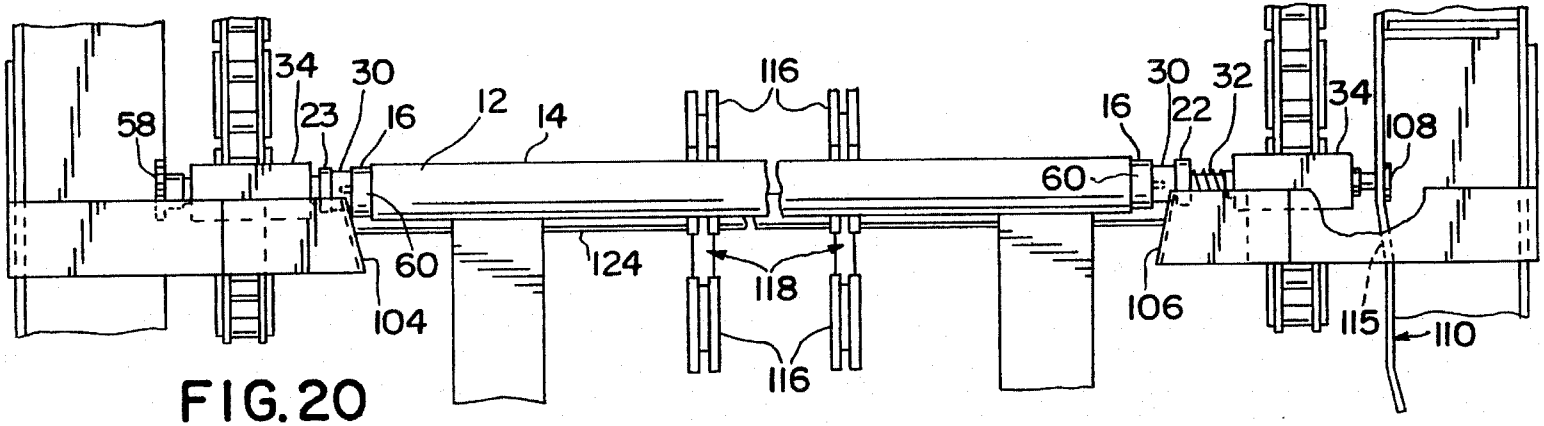
FIG. 20 is a foreshortened plan view taken along line 20—20 in FIG. 18 and shown with portions broken away for clarity.
Figure 21:
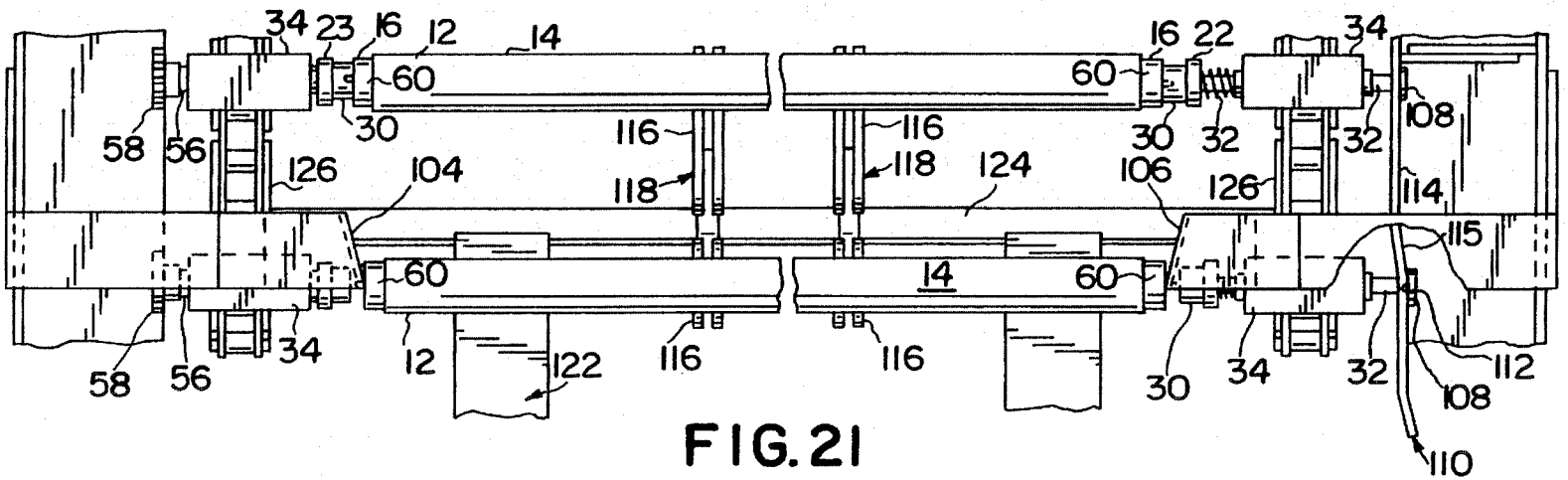
FIG. 21 is a foreshortened plan view similar to that of FIG. 20 showing a fluorescent lamp in an advanced position relative to its position in FIG. 20.
Figure 22:
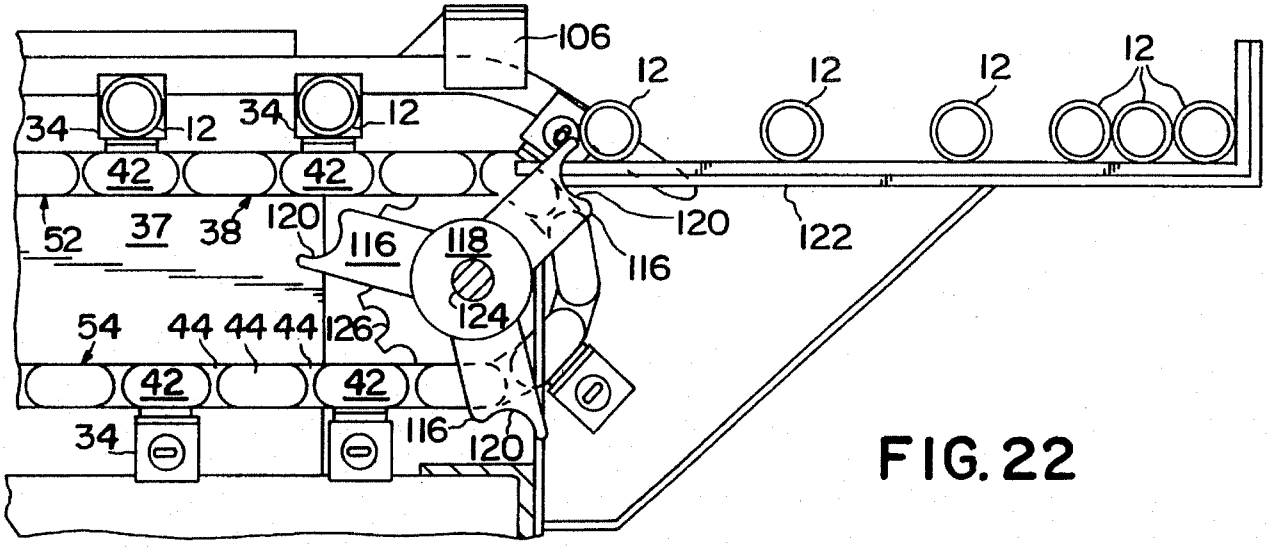
FIG. 22 is a sectional elevational view taken substantially along line 22—22 in FIG. 19.

Upon emerging from the cooling chamber 102, the lamps 12 are transported to a release-and-delivery location. At the release-and-delivery location, the end surfaces 20 of the end caps 16 of the lamps are engaged by guides 104 and 106 which shift the lamp slightly, laterally away from the axially-fixed adapter, and maintain the lamp in the slightly-shifted lateral position as it advances. The axially-movable adapter is simultaneously pulled outward by engagement of a flange 108 on the adapter shaft 32 by a fixed cam arm 110. As shown in FIGS. 19–21, the inside surface 112 of the flange 108 first engages the cam arm 110 along a first portion 114 substantially parallel to the direction of travel of the lamps. A second portion 115 of the cam arm 110 is angled outward to pull the axially-movable adapter 22 outward, away from the associated end surface 20 of the lamp, while the lateral position of the lamp is controlled by the guides 104.

Figure 18:
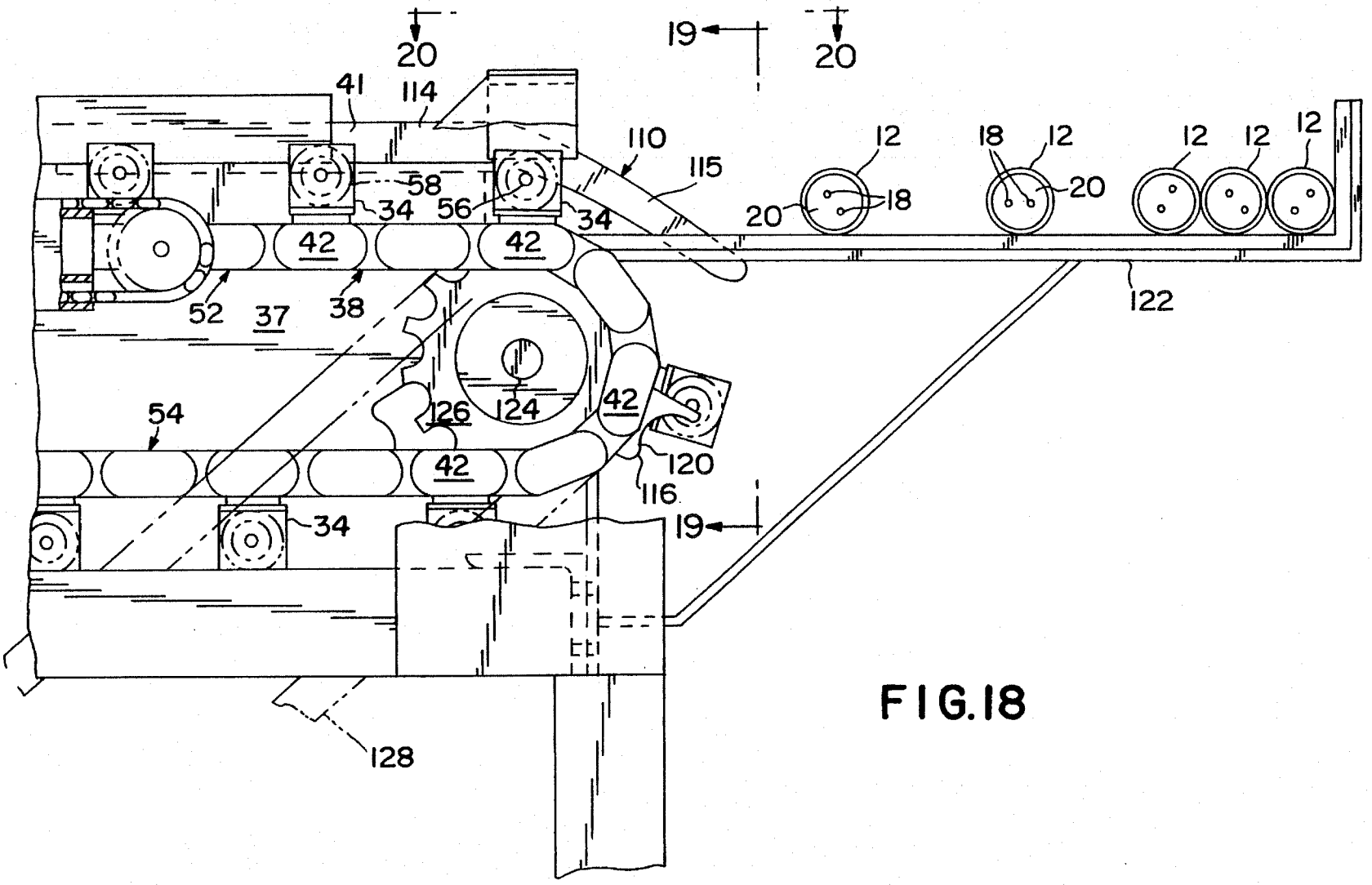
FIG. 18 is an elevational view of a portion of the apparatus of FIG. 1 at the right-hand end thereof, shown on an enlarged scale relative to FIG. 1 and with portions broken away for clarity.

As the adapter 22 is pulled outward, the lamp is engaged from below by a pair of fingers 116 on a pair of rotating take-off wheels 118. Each of the fingers 116 has an arcuate surface 120 which complements the exterior surface of the glass tube 14, so that as the take-off wheels 118 rotate, the lamp 12 is lifted slightly and carried forward by the fingers 116 as it is released from the adapters 22 and 23. The lamp is carried by the fingers 116 through an are of approximately 120° and deposited on a delivery rack 122. The take-off wheels 118 preferably are fixedly mounted on a common shaft 124 with a pair of main drive sprockets 126, which drive the main drive chains 38, so that the take-off wheels 118 rotate at the same rotational velocity as the main drive sprockets 126. This ensures that a timed relationship is maintained between the take-off wheels and the main drive chain. The main drive chain is driven by a motor disposed below and offset from the shaft 124, and connected thereto by a separate drive chain 128, as shown in FIG. 18.

A suitable control system is employed to enable adjustment of the speed of the main drive chain. The oven temperatures are monitored and controlled by a control system which displays data needed by the operator and permits adjustments to be made through a control panel 132.

Figure 4:
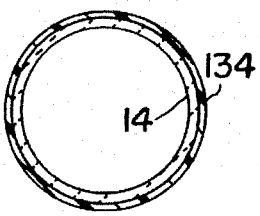
FIG. 4 is a sectional view taken substantially along line 4—4 in FIG. 3.

As shown in FIGS. 3 and 4, the coated lamp has a transparent layer 134 of PVC covering peripheral portions 60 of the end caps 16 as well as the glass tube 14 therebetween. Prior to the initial heating of each lamp, a label 130 is preferably applied to the glass surface of each lamp, adjacent one end of the glass tube 14, as shown in FIG. 3. The labels may be composed of a static cling vinyl material, which causes the label to be retained on the glass surface without the use of adhesives. Another suitable label is made of a vinyl material having an adhesive thereon to aid in retaining the labels in the desired position on the lamps during the coating process. Each label is preferably elongated and extends circumferentially about the tube 14. The label 130 may have a length greater than the circumference of the tube 14, so that the ends of the labels overlap, or may have a length slightly less than the lamp circumference as shown in FIG. 3. After dipping of the lamp in the liquid PVC plastisol and curing of the plastisol, the coating over the label is smooth and uninterrupted. The preferred PVC coating bonds or adheres to the label so that it is difficult for the label to be separated from the coating, even if the coating is removed from the lamp.

From the foregoing it should be appreciated that the invention provides an improved method and apparatus for coating fluorescent lamps, and provides an improved tamper resistant labeling arrangement therefor. The method and apparatus enable the lamps to be advanced in continuous travel as they are prepared for coating, then coated, and finally removed from the apparatus. The invention is not limited to the particular embodiments described above, nor to any particular embodiments. The invention is described in more detail in the following claims.

What is claimed is:

1. A tamper-resistant coated and labeled fluorescent lamp comprising a light-transmitting envelope defining an enclosed interior;

means for conducting electrical energy to said enclosed interior from outside of said enclosed interior;

means disposed within said enclosed interior to emit light when stimulated by said electrical energy;

a tough, smooth, uninterrupted, substantially transparent coating covering said envelope to contain said envelope and contents thereof in the event of failure of said envelope; and a label adhered to said envelope and entirely covered by said coating, said label being bonded to said coating to be non-peelable and non-separable from the coating to prevent removal and misuse at the end of the useful life of the lamp;

said coating functions in a dual role of providing resistance to tampering with said non-separable label in addition to said containment of said envelope and thereof contents in the event of failure of said envelope.

2. A tamper-resistant coated and labeled fluorescent lamp comprising:

an elongated glass tube defining an enclosed interior;

a pair of metallic end caps disposed at opposite ends of said glass tube;

at least one electrical connecting pin extending outward, generally perpendicular to the end surface of each end cap;

means disposed within said enclosed interior to emit light when stimulated by electrical energy;

a label adhered to said glass tube; and a tough, smooth, uninterrupted, substantially transparent coating covering said label, said glass tube and portions of said end caps;

said coating being bonded to said label;

said coating functions in a dual role of providing resistance to tampering with said label to resist removal and misuse thereof at the end of the useful life of the lamp, in addition to providing containment of said glass tube and contents thereof in the event of breakage of the glass tube.

3. A coated and labeled fluorescent lamp in accordance with claim 2 wherein said label is made of a vinyl material.

4. A coated and labeled fluorescent lamp in accordance with claim 3 wherein said label is composed of a static cling vinyl material.

5. A coated and labeled fluorescent lamp in accordance with claim 3 wherein said tough, substantially transparent coating is composed of a transparent layer of polyvinyl chloride.

6. A tamper-resistant coated and labeled fluorescent lamp comprising:

an elongated glass tube defining an enclosed interior;

a pair of metallic end caps disposed at opposite ends of said glass tube;

a label; and a tough, smooth, uninterrupted, light transmitting coating covering said label, said glass tube and portions of said end caps;

wherein the lamp is coated and labeled by applying the label to the elongated glass tube of the lamp; then heating the lamp with the label thereon; then bringing the lamp and label into contact with a coating material, and subsequently reheating the lamp and label with the coating material thereon;

said coating material being bonded to said label so that said coating provides resistance to tampering with the label to resist removal and misuse of the label at the end of the useful life of the lamp, in addition to providing containment of the glass tube in the event of breakage thereof.

7. A coated and labeled fluorescent lamp in accordance with claim 6 wherein said label is made of a material having an adhesive thereon to aid in retaining the label in the desired position on the lamp during the coating process.

8. A coated and labeled fluorescent lamp in accordance with claim 6 wherein said bringing the lamp and label into contact with a coating material comprises dipping the lamp into contact with the surface of a bath of liquid plastisol while the lamp is rotated about its longitudinal axis.

9. A coated and labeled fluorescent lamp in accordance with claim 6 wherein said heating the lamp with the coating material thereon comprises heating the lamp at a time and temperature sufficient to effect gelation of said coating.

10. A tamper-resistant coated and labeled fluorescent lamp in accordance with claim 6 wherein said heating the lamp with the label thereon before application of the coating material comprises employing electric radiant heaters to raise the surface temperature of the lamp to at least about 125° F.

11. A coated and labeled fluorescent lamp in accordance with claim 10 wherein said reheating the lamp and label with the coating thereon comprises maintaining the lamp and label with the coating thereon in an oven for at least about three minutes, and wherein the oven temperature is at least about 400° F.

* * * * *

UNITED STATES PATENT AND TRADEMARK OFFICE

CERTIFICATE OF CORRECTION

PATENT NO. : 5,532,549

DATED : July 2, 1996

INVENTOR(S) : Edward F. DUZYK et al.

It is certified that error appears in the above-indentified patent and that said Letters Patent is hereby corrected as shown below:

Column 9, line 51, change "thereof contents" to --contents thereof--.

Signed and Sealed this

Eighth Day of October, 1996

Bruce Lehman

*Attest:*

BRUCE LEHMAN

*Attesting Officer*

*Commissioner of Patents and Trademarks*